United States Patent [19]

Eguchi et al.

[11] Patent Number: 4,775,820

[45] Date of Patent: Oct. 4, 1988

[54] MULTILAYER ELECTROLUMINESCENT DEVICE

[75] Inventors: Ken Eguchi, Yokohama; Haruki Kawada, Kawasaki; Yukuo Nishimura, Sagamihara, all of Japan

[73] Assignee: Canon Kabushiki Kaisha, Tokyo, Japan

[21] Appl. No.: 760,089

[22] Filed: Jul. 29, 1985

[30] Foreign Application Priority Data

| | | | |
|---|---|---|---|
| Jul. 31, 1984 | [JP] | Japan | 59-158801 |
| Jul. 31, 1984 | [JP] | Japan | 59-158802 |
| Jul. 31, 1984 | [JP] | Japan | 59-158803 |
| Jul. 31, 1984 | [JP] | Japan | 59-158804 |
| Jul. 31, 1984 | [JP] | Japan | 59-158805 |
| Jul. 31, 1984 | [JP] | Japan | 59-158806 |
| Jul. 31, 1984 | [JP] | Japan | 59-158807 |

[51] Int. Cl.[4] ..... H01J 1/63; G03G 5/02

[52] U.S. Cl. ..... 313/504; 313/509; 252/600

[58] Field of Search ..... 313/504, 509, 498; 252/600

[56] References Cited

U.S. PATENT DOCUMENTS

| | | | |
|---|---|---|---|
| 3,172,862 | 3/1965 | Gurnee et al. | 313/504 |
| 3,173,050 | 3/1965 | Gurnee | 313/108 |
| 3,359,445 | 12/1967 | Roth | 313/504 |
| 3,382,394 | 5/1968 | Mehl | 313/108 |
| 3,621,321 | 11/1971 | Williams et al. | 313/108 A |
| 3,710,167 | 1/1973 | Dresner et al. | 313/108 A |
| 3,995,299 | 11/1976 | Partridge | 357/8 |
| 4,356,429 | 10/1982 | Tang | 313/503 |
| 4,539,507 | 9/1985 | VanSlyke et al. | 313/504 |
| 4,542,712 | 9/1985 | Sato et al. | 118/726 |

FOREIGN PATENT DOCUMENTS 53125278 1/1978 Japan .

OTHER PUBLICATIONS

Engler et al. "New Electrochemical Fluorescent Display Material With Memory", *IBM Technical Disclosure Bulletin*, 22 (Jul. 1978).

Allan, "Atoms Add Luster To Electroluminescence", *Electronics Review*, 53, pp. 42-44, (May 22, 1980).

*Primary Examiner*—Matthew A. Thexton
*Assistant Examiner*—Catherine S. Kilby
*Attorney, Agent, or Firm*—Fitzpatrick, Cella, Harper & Scinto

[57] ABSTRACT

An electroluminescent device comprises a pair of electrodes and a luminescent layer sandwiched between the electrodes, the luminescent layer comprising:

(a) one layer comprising a relatively electron-acceptable organic compound, (b) another layer containing a relatively electron-donative organic compound, and (c) still another layer having an insulating property, the three layers being repeatedly accumulated, and at least one of the three layers having a monomolecular film or a monomolecular layer built-up film.

25 Claims, 3 Drawing Sheets

MULTILAYER ELECTROLUMINESCENT DEVICE

BACKGROUND OF THE INVENTION

1. Field of the invention

This invention relates to an electroluminescent device (hereinafter referred to as "EL-device") and, more particular, to an EL-device comprising a layer having an electroluminescent function (hereinafter referred to as "EL-function") constituted of a combination of two types of thin films composed of organic compounds having electrochemical characteristics different from each other.

2. Description of the Prior Art

An EL-device is constituted of a luminescent layer composed of a material having EL-function, that is, a material capable of emitting light when placed in an electric field, sandwiched between two electrodes, and is a luminescent device which can convert electric energy directly into light when a voltage is applied across the electrodes. The EL-device is different from conventional luminescent systems such as an incandescent lamp which emits light by making a filament incandescent, a fluorescent lamp where a gas excited electrically imparts an energy to a fluorescent substantially to emit light, and the like. Therefore, EL-devices can be expected to be used as constitution materials for lamps and display mediums used for displaying lines, figures, images and the like of various shapes such as thin panel, belt, cylinder and the like, or further, a luminescent body of a large area such as panel lamps and the like. These points of EL-device draw attention.

Depending on the luminescent mechanism, EL-devices are generally classified into two classes, i.e. an intrinsic EL system where an electric field excited luminescence is conducted accompanied by movement of carrier in the luminescent layer and a carrier injection EL system where an electric field excited luminescence is carried out by injecting carriers into a luminescent layer.

In addition, EL-devices may be classified into another two classes, depending on the structure of the luminescent layer, i.e. a thin film type having a thin film composed of a material of EL function as a luminescent layer and a powder type having a luminescent layer composed of a material of EL function dispersed in a binder.

As the material of EL function, there have been known heretofore inorganic metal materials such as ZnS containing Mu, Cu, $ReF_3$ (Re: rare earths) or the like as an activating agent, and the like.

In the case of a thin film type EL device, the structure is suitable for the following purposes, that is, a thin luminescent layer can be formed so as to sufficiently shorten the distance between the electrodes and a strong electric field can be formed in the luminescent layer so as to produce a good luminescence of high luminance even by a low voltage driving. However, where the above-mentioned inorganic metal material such as ZnS is used to form a thin film type luminescent layer by a thin film forming method such as vapor deposition and the like and a thin film type EL device is fabricated, the manufacturing cost is very high. In addition, it is very difficult to form a luminescent layer composed of a uniform thin film of a large area and therefore, it is not possible to produce EL-devices of good quality and large area by mass production.

On the contrary, as an EL-device which is suitable for mass production and inexpensive, there are known organic powder type EL-devices of an intrinsic EL system where the above mentioned EL intrinsic material mainly composed of ZnS is dispersed in an organic binder to form a luminescent layer.

However, in the powder type EL-device, when the luminescent layer is made thin, defects such as pinhole and the like are liable to be formed in the luminescent layer, Thus, in view of the limitation due to the sturcture, it is difficult to make the luminescent layer thinner than a certain thickness for enhancing sufficiently the luminescent characteristics, and therefore sufficient luminescence, in particular, a high luminance, can not be obtained. Further, since the thickness of the luminescent layer becomes relatively thick, power consumption is disadvantageously large for generating a strong electric field.

For the purpose of generating a stronger electric field in the luminescent layer of the powder type EL-device, Japanese patent applicaiton Laid-open No. 172891/1983 discloses an improved EL-device comprising an intermediate dielectric layer composed of a polymer of vinylidene fluoride in a luminescent layer of powder type.

However, satisfactory luminance and desirably low power consumption have not been achieved.

On the contrary, in place of conventional metallic or inorganic materials, it has been recently contemplated to employ organic compound materials which can be formed into a thin fill of high precision by utilizing various thin film forming methods, and control their chemical structures and high order structures so as to use them as optical and electronics materials in the form of an electrochromic device, piezoelectric device, pyroelectric device, nonlinear optical device, ferroelectric liquid crystal or the like. Also expected is the use of such organic materials as a materaial for constituting a luminescent layer of EL-devices.

Among the organic materials for a luminesenesent layer of EL-devices, there are known anthrancene, pyrene, perylene, their derivatives and the like. Japanese patent application Laid-open No. 35587/1977 discloses an EL-device of carrier injection type where a monolmolecular layer built-up film of the above-mentioned materials is used as a luminescent layer.

However, in this EL-device though the luminescent layer is formed by a thin film of high precision, the density of carriers, that is, electrons and holes, is so small that the excitation probability of the functional molecules due to movement and recombination of carriers is low and thereby, an efficient luminsence can not be produced. In particular, the power consumption and luminace are not yet satisfactory.

SUMMARY OF THE INVENTION

An object of the present invention is to provide an EL-device free from the above-mentioned drawbacks.

Another object of the present invention is to provide an EL-device of good luminescent efficiency, capable of giving a sufficiently high luminance even by a low voltage drive, of low cost and having a structure which can be easily fabricated.

A further object of the present invention is to provide an EL-device having a structure which can be formed by appropriately selecting a material from various organic compound materials for EL-devices and using an optimal thin film producing method for the selected material and to which desirable luminescent characteristics can be easily imparted.

According to one aspect of the present invention, there is provided an electroluminescent device which comprises a pair of electrodes and a luminescent layer sandwiched between the electrodes, the luminescent layer comprising:

(a) a first layer comprising a relatively electron-acceptable organic compound, (b) a second layer containing a relatively electron-donative organic compound, and (c) a third layer having an insulating property, the three layers being repeatedly accumulated at least twice, and at least one of the three layers having a monomolecular film or a monomolecular layer built-up film.

According to another aspect of the present invention, there is provided an electroluminescent device which comprises a pair of electrodes and a luminescent layer sandwiched between the electrodes, the luminescent layer comprising:

(a) a first layer comprising a relatively electron-acceptable organic compound, (b) a second layer containing a relatively electron-donative organic compound, and (c) a third layer having an insulating property, these layers being aranged such that, in the direction of from one electrode to the other electrode, on the third layer there are successively overlaid the first layer, the second layer and another third layer in the mentioned order and this three-layer set is accumulated at least twice, and at least one of the three layers having a monomolecular film or a monomolecular layer built-up film.

At least one of the pair of electrodes may be transparent.

BRIEF DESCRIPTION OF THE DRAWING

FIGS. *3a*, *3b*, *3c*, and *3d* schematically show representative examples of arangements of molecules at the interface between a first layer and a second layer in EL-devices of the present invention; and FIG. 4 is a schematic cross sectional view of an EL cell in which an EL-device of the present invention is built in.

DESCRIPTION OF THE PREFERRED EMBODIMENTS

Figure 1:
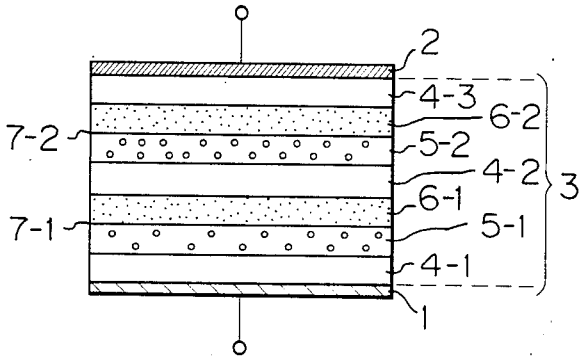
FIG. 1 is a schematic cross sectional view of an embodiment of the EL-device according to the present invention.

The EL-device of the present invention is a thin film type EL-device of so-called intrinsic EL system comprising a luminescent layer having EL function with an intervening insulating layer, sandwiched between a pair of electrodes. The feature of the present invention resides in the structures of the luminescent layer. At least one electrode of the pair of electrodes may be transparent.

The luminescent layer of EL-device according to the present invention has a structure that a relatively electron-acceptable organic compound (hereinafter referred to as "EA compound") and a relatively electron-donative organic compound (hereinafer referred to as "ED compound") are contacted with each other. When these compounds are placed in an electric field, acceptance and donation of electronics between these compounds occur and an excited complex is formed resulting in emitting light. This luminescence is used as a main luminescent source.

The structure of the EL-device of the present invention is suitable for producing efficiently such an excited complex as the electric field is generated.

Referring to the drawing the EL-device of the present invention will be explained more in detail below.

The like numerals in the drawing indicate the like portions.

FIG. 1 is a schematical cross sectional view of an embodiment of the EL-device of the present invention.

1 and 2 are electrodes applying voltage to the luminescent layer so as to generate an electric field. 1 is a transparent electrode to take out generated light. 3 is a luminescent layer having EL function and is a multilayered structure, that is, at the both ends are provided third layers 4-1 and 4-3 which are insulating layers, and between the third layers are laminated alternatively first layers 5-1 and 5-2, second layers 6-1 and 6-2, and a third layer 4-2.

At least one layer of the three kinds of layers is a monomolecular film or a monomolecular layer built-up film composed of a compound which can form the layer.

In luminescent layer 3, a first layer 5-1 contains a contains a compound which can be an EA compound relative to an ED compound contained in a second layer 6-1, and the second layer 6-1 directly contacting a first layer 5-1 contains a compound which can be an ED compound relative to an EA compound contained in the first layer 5-1. The interface 7-1 between the first layer 5-1 and the second layer 6-6 is a Contacting surface between an EA compound and an ED compound. The relation between the first layer 5-2 and the second layer 6-2 is similar to that as mentioned above, and an interface 7-2 is independently formed by these layers.

When a voltage is applied across luminescent layer 3 through electrodes 1 and 2, the EA compound and the ED compound form a complex in a excited state at interfaces 7-1 and 7-2, and when the excited complex returns to the ground state, the excitation energy is emitted in the form of light from the excited complex, EA compound and/or ED compound. As mentioned above, the luminescence in the EL-device of the present invention is mainly based on luminescence at the interfaces 7-1 and 7-2.

First layers 5-1 and 5-2, and second layers 6-1 and 6-2 may be independently constituted of monomolecular films or monomolecular layer built-up films composed of molecules of compounds directly participating in the formation of electric field excited complexes or molecules of compounds having at least one of the above-mentioned molecules of compounds as a functional moeity as shown below. However, the first layer, second layer and third layer are not simultaneously composed of materials other than monomolecular films and monomolecular layer built-up films.

Representative arrangements in luminescent layer 3 of molecules of compounds directly participating in the formation of electric field excited complexes are as shown below.

(a) First layers 5-1, 5-2 and second layers 6-1, 6-2 contains respective molecules of compounds having EL function based on the formation of exicted complexes (mainly luminescence).

(b) First layers 5-1 and 5-2 contain molecules of compound having EL function based on the formation of excited complexes, and second layers 6-1 and 6-2 contain respective molecules of compounds which can be electron donors relative to the compounds in the respective first layers (ED compound)

(c) Second layers 6-1 and 6-2 contain molecules of compounds having EL function based on the formation of excited complexes and first layers 5-1 and 5-2 contain respective molecules of compounds which can be electron acceptors relative to the compounds in the respective second layer (EA compound).

As the compounds having EL function based on the formation of the excited complex, there are preferably used organic compounds having a high luminescent quantum efficiency and electron system susceptible to external perturbation and capable of being excited easily by electric field.

As such compounds, there may be mentioned, for example, fused polycyclic aromatic hydrocarbons, p-terphenyl, 2,5-diphenyloxazole, 1,4-bis(2-methylstyrl)-benzene, xanthine, coumarin, acridine, cyanine dye, benzophenon, phtalocyanine and metal complexes thereof, porphyrin and metal complexes thereof, 8-hydroxyquinoline. and metal complexes thereof, ruthenium complexes, rare earth complexes and derivatives of the above-mentioned compounsds, and furthermore, compounds having EL function based on the formation of excited complex selected from heterocyclic compounds other than those mentioned above, derviatives thereof, aromatic amines, aromatic polyamines, and compounds having a quinone structure.

From these compounds, one or more compounds which can be relatively EA compounds and one or more compounds which can be relatively ED compounds may be appropriately selected and combined to form a luminescent layer of the structure (a) comprising first layers and second layers. When the layers are in a form of a monomolecular film or a monomolecular layer built-up film, a monomolecular layer building up method (infra) may be used.

When the layers are constituted in a way different from those as mentioned above, they may be produced, for example, by a thin film forming method such as vapor deposition, CVD and the like.

In addition, as the compounds which can be electron acceptors or electron donors relative to the above-mentioned compounds having EL function based on the formation of excited complexes, there may be mentioned heterocyclic compounds other than those mentioned above, derivatives thereof, aromatic amines, aromatic polyamines, compounds having a quinone structure, tetracyanoquinodimethane, tetracyanoethylene and the like.

By combining the previously mentioned compounds with the above-mentioned compounds accordingly, there can be formed the luminescent layer having the structure (b) or (c) of the first layers and the second layers.

The above mentiond compounds having functional portion may be those having a function of luminescence which is not based on the formation of excited complex.

The luminescence in EL-device of the present invention is not limited to that at the interfaces 7-1 and 7-2 between the first layer and the second layer, but may contain the case that luminescence occurs in first layers 5-1 and 5-2, and/or second layers 6-1 and 6-2.

For producing a monomolecular film or a monomolecular built-up film containing the above-mentioned compounds, or compounds having at least one molecule of said compounds as a functional moiety or portion, the so-called monomolecular built-up method is preferably applicable, which enables a highly-ordered molecular orientation and arrangement to form simply an ultrathin film layer.

The monomolecular built-up method is based on the following principle. That is, for example, in molecules with a structure having a hydrophilic group and a hydrophobic group in the molecule, when the balance between the both groups amphiphilic (balance) is adequately maintained, a large number of such molecules will form a layer of monomolecules with the hydrophilic group pending downward on the water surface. The monomolecular layer on the water surface has the characteristics of a two-dimensional system. When the molecules are spread sparsely, between the area per one molecule and the surface pressure $\pi$ the formula of the two-dimensional ideal gas:

$$\pi A = kT$$

is valid (where k is the Boltzman's constant and T is the absolute temperature). While these molecules form a "gaseous film", if A is made sufficiently small, the interaction between the molecules will be strengthened to made the film a "condensed film (or solid film)". The condensed film can be transferred onto the surface of a substrate such as glass, etc., and an ultra-thin monomolecular film or its built-up film can be formed on the substrate.

According to this method, the directions in which the molecules for forming the monomolecular film may be made uniform within one monomolecular film, as exemplified by a highly-ordered orientation of substantially all of the hydrophilic moieties of the constituent molecules toward the substrate side. Accordingly, by forming the interface between the first layer and/or the second layer in the EL device of the present invention using a monomolecular film or a monomolecular layer built-up film, it is rendered possible to arrange the functional moieties comprising compound molecules participating directly in formation of excited complexes contained in the layer formed as the monomolecular film or the monomolecular layer built-up film at a high density at the interface between the first layer and the second layer.

As the solution for formation of monomolecules in the monomolecular built-up method, various solutions may be available, and depending on the solution employed, compounds for formation of monomolecular film having well-balanced moieties different in affinity for said solution can be selected appropriately to form monomolecular films. Among such solutions for formation of monomolecular films, water and aqueous solutions composed mainly of water may preferably be used in view of its low cost, ease in handling as well as safety.

Referring now to an example in which the monomolecular built-up method using water or a solution mainly composed of water is applied, the constitution of the luminescent layer in the EL device of the present invention is to be described.

Figure 2:
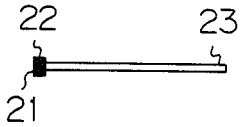
FIG. 2 schematically shows molecular structures of compounds for forming monomolecular films.
Figure 2:
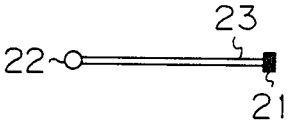
Figure 2:
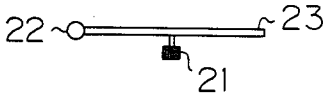

Basically, the compound capable of forming the first layer and the second layer possessed by the luminescent layer in the EL device of the present invention is a compound capable of forming the functional moiety as described above or a compound having at least one of said compound molecules as the functional moiety. Of these compounds, those capable of forming a monomolecular film, when taking an example of the compounds having one functional moiety, may be classified broadly into the three types depending on the position having the functional moiety in the molecule, as shown in the schematic illustration of the molecular structure shown in FIG. 2, namely:

(a) the functional moiety 21 exists on the hydrophilic portion 22 side—FIG. 2(*a*);

(b) the functional moiety 21 exists on the hydrophobic portion 23 side—FIG. 2(*b*); and (c) the functional moiety 21 exists at approximately the middle between the hydrophobic portion 23 and the hydrophilic portion 22—FIG. 2(*c*).

As the constituent element of the hydrophilic portion 22 of these compounds, there may be included, for example, carboxyl group and its metal salt, amine salt and ester, sulfonic acid group and its metal salt and amine salt, sulfonamide group, amide group, amino group, imino group, hydroxyl group, quaternary amino group, oxyamino group, oxyimino group, diazonium group, guanidine group, hydrazine group, phosphoric acid group, silicic acid group, aluminic acid group, etc., and each or a combination of these groups can constitute the hydrophilic portion 22 in the above compound.

On the other hand, the constituent element of the hydrophobic portion 23 may include groups exhibiting hydrophobic property such as straight or branched alkyl group, olefinic hydrocarbon such as vinylene, vinylidene, acetylene, etc., phenyl, fused polycyclic phenyl such as naphthyl, anthranyl, etc., chain polycyclic phenyl such as biphenyl, etc., and each or a combination of these groups can constitute the hydrophobic portion 23 in the above compound.

Figure 3A:
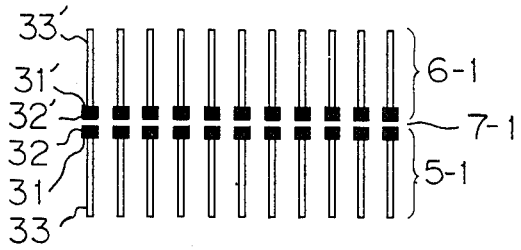
Figure 3A:
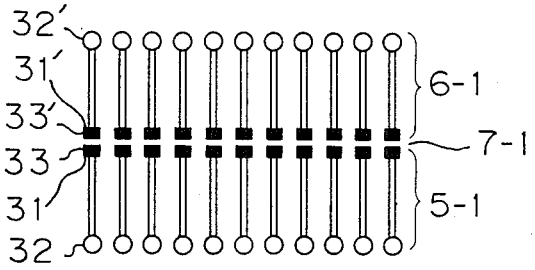
Figure 3B:
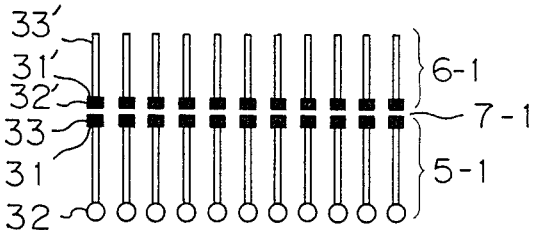
Figure 3B:
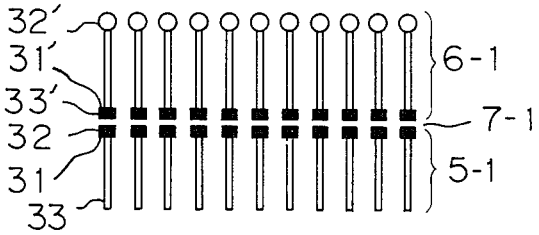

On the other hand, the orientation and arrangement of the monomolecular films at the interfaces 7-1, 7-2 (the portion where luminescence is effected primarily) between the first layer and the second layer of the luminescent layer in the EL device of the present invention may be classified basically into the following four patterns, as shown in the schematic sectional partial view around the interface 7-1 in FIGS. 3*a* and 3*b* (in the case of these FIG.s, both the first layer and the second layer are formed of a monomolecular film consisting only of the compound having functional moiety)

(1) the hydrophilic portion 32 having the functional moiety 31 of molecule for forming monomolecular film of the first layer 5-1 and the hydrophilic portion 32' having the functional moiety 31' of molecule for forming monomolecular film of the second layer 6-1 are oriented on the interface 7-1 —FIG. 3*a*(*a*)-;

(2) the hydrophobic portion 33 having the functional group 31 of molecule for formation of monomolecular film of the first layer 5-1 and the hydrophobic portion 33' having the functional moiety 31' of molecule for formation of monomolecular film of the second layer 6-1 are oriented on the interface 7-1—FIG. 3*a*(*b*);

(3) the hydrophobic portion 33 having the functional moiety 31 of molecule.for forming monomolecular film of the first layer 5-1 and the hydrophilic portion 32' having the functional moiety 31' of molecule for forming monomolecular film of the first layer 5-1 and the hydrophilic portion 32' having the functional moiety 31' of molecule for forming monomolecular film of the second layer 6-1 are oriented on the interface 7-1—FIG. 3*b*(*a*);

(4) the hydrophilic portion 32 having the functional moiety 31 of molecule for formation of monomolecular film of the first layer 5-1 and the hydrophobic portion 33' having the functional moiety 31' of molecule for formation of monomolecualr film 6-1 of the second layer are oriented on the interface 7-1—FIG. 3*b*(*b*)

For forming such patterns of interface in a luminescent layer, the above-mentioned compounds for formation of monomolecular film belonging to type a and type b are preferably used. For forming the pattern of interface (1), compounds belonging to the type a are preferably used for the first layer and the second layer; for forming the pattern of interface (2), compounds belonging to the type b are preferably used for the first layer and the second layer. Further, for forming the pattern of interface (3), a compound of the type a and a compound of the type b are preferably used for the first layer and the second layer, respectively. For forming the pattern of interface (4), a compound of type b and a compound of type a are preferably used for the first. layer and the second layer, respectively.

In the above-mentioned examples, the first layer and the second layer are composed of respective monomolecular films, but a similar procedure can be used even when the first layers 5-1 and 5-2 and/or the second layers 6-1 and 6-2 are composed of monomolecular layer built-up films, that is, monomolecular films constituting interfaces between the first layer and the second layer, 7-1 and 7-2, are formed so as to give the above mentioned pattern to the interface between the first and the second layers.

Figure 3C:
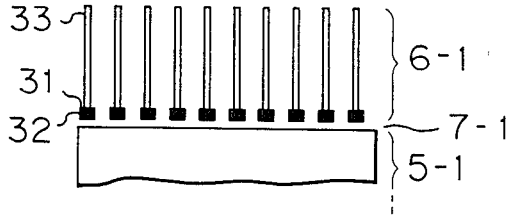
Figure 3C:
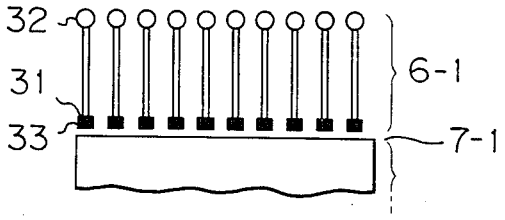

In another case, in FIG. 3C, the orientation and arrangement of the monomolecular films at the interfaces 7-1 and 7-2 (the portions where luminescence occurs mainly) between the first layer and the second layer of the luminescent layer in the EL device of the present invention may be classified basically into the following two patterns, as shown in the schematic sectional partial view around the interface 7-1 in FIG. 3*c* (in this FIG., the second layer is constituted of a monomolecular film composed of a compound having one functional moiety)

(1) the hydrophilic portion 32 having the functional moiety 31 of molecule for forming a monomolecular film of the second layer 6-1 is oriented on the interface 7-1—FIG. 3*c*(*a*);

(2) the hydrophobic portion 3*e* having the functional moiety 31 of molecule for forming a monomolecular film of the second layer 6-1 is oriented on the interface 7-1—FIG. 3*c*(*b*).

For forming the pattern of interface in the luminescent layer, there are preferably used compounds belonging to the type a and the type b.

Further, for forming the pattern of interface (1), the second layer is preferably formed by using a compound of the type a, and for forming the pattern of interface (2), the second layer is preferably formed by using a compound of the type b.

In the above-mentioned examples, the second layer is composed of a monomolecular film, but a similar procedure can be used even when the second layers 6-1 and 6-2 are composed of monomolecular layer built-up films, that is, monomolecular films constituting the interfaces of the first layer and the second layer, 7-1 and 7-2, are formed so as to have the above-mentioned pattern of interface between the first layer and the second layer.

Figure 3D:
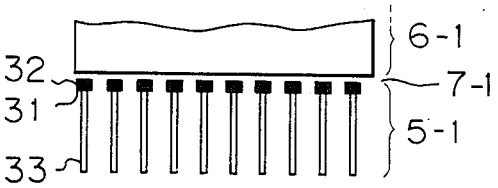
Figure 3D:
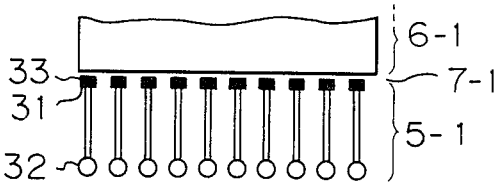

In a further case, in FIG. 3*d*, the orientation and arrangement of the monomolecular films at the interfaces 7-1 and 7-2 (the portions where luminescence occurs mainly) between the first layer and the second layer of the luminescent layer in the EL device of the present invention may be classified basically into the following two patterns, as shown in the schematic sectional partial view around the interface 7-1 in FIG. 3*d*(in this Figure, the first layer is constituted of a monomolecular film composed of a compound having one functional moiety):

(1) the hydrophilic portion 32 having the functional moiety 31 of molecule for forming a monomolecular film of the first layer 5-1 is oriented on the interface 7-1—FIG. 3*d*(*a*);

(2) the hydrophobic portion 33 having the functional moiety 31 of molecule for forming a monomolecular film of the first layer 5-1 is oriented on the interface 7-1—FIG. 3*d*(*b*).

For forming the pattern of interface in the luminescent layer, there are preferably used compounds belonging to the type a and the type b.

Further, for forming the pattern of interface (1), the first layer is preferably formed by using a compound of the type a, and for forming the pattern of interface (2), the first layer is preferably formed by using a compound of the type b.

In the above-mentioned examples, the first layer is composed of a monomolecular film, but a similar procedure can be used even when the first layers 5-1 and 5-2 are composed of monomolecular layer built-up films, that is, monomolecular films constituting the interfaces of the first layer and the second layer, 7-1 and 7-2, are formed so as to have the above-mentioned pattern of interface between the first layer and the second layer.

When in FIG. 1 the first layers 5-1, 5-2 and/or the second layers 6-1, 6-2 are composed of monomolecular layer built-up films, respective monomolecular films constituting the built-up films may be the same or one or more monomolecular films may be different from other monomolecular films. Further, the structure depending on the oriented state of the molecules forming the respective monomolecular films of the monomolecular layer built-up films may be made variously. For example, the so-called Y type (the structure in which the hydrophilic portions are faced to hydrophilic portions, or hydrophilic portions to hydrophilic portions between respective films), X type (the structure in which the hydrophobic poritons are faced toward the substrate side of respective films), Z type (the structure in which the hydrophilic portions are faced toward the substrate side of respective films) and modified structures of these. Further, the monomolecular film included in the first layer and the second layer of the luminescent layer possessed by the EL device of the present invention may be a multi-component monomolecular film formed of two or more compounds. In such a case, two or more compounds having functional moieties can be combined, or further it is possible to add another component for increasing the strength of the monomolecular layer constituting the luminescent layer or improving adhesion between the respective layers.

Such a structure of a monomolecular film or a monomolecular layer built-up film can be adequately chosen depending on the electrical characteristics of the first layer and the second layer, namely the compound or a combination of compounds forming the first layer or the second layer. For example, the potential curve of $\pi$ electrons in the direction perpendicular to the monomolecular film plane can be controlled by building up monomolecular films of a combination of the compounds belonging to the type a, b or c (cf. FIG. 2) of the compounds for formation of monomolecular films as mentioned above.

As the compounds for forming the above-mentioned first layers 5-1, 5-2 and second layers 6-1, 6-2, there may be used the above-mentioned compounds having at least one functional portion.

Of these compounds, those having well-balanced hydrophilic portions and hydrophobic portions may be directly used as such for forming monomolecular films. Otherwise, the hydrophilic groups and/or hydrophobic groups as mentioned above may be introduced newly into the molecules to form compounds suitable for formation of monomolecular films. As such compounds, the compounds represented by the structural formulae shown below may be employed.

In the structural formulae shown below, X and Y represent hydrophilic groups as mentioned above. When both of them exist in one molecule, either one of them may be hydrophilic and, in such a case, the other is hydrogen. In these formulae, W represents a hydrophobic group as mentioned above, and R represents a straight or branched alkyl group having about 4 to 30 carbon atoms, preferably about 10 to 25 carbon atoms.

1.

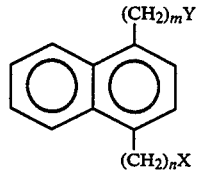

$0 \leqq m, n \leqq 25, 10 \leqq m + n$

2.

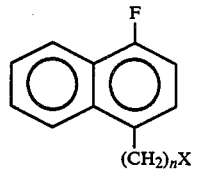

$10 \leqq n \leqq 25$

3.

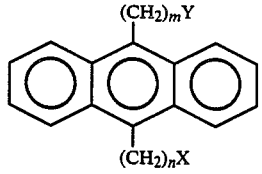

$0 \leqq m, n \leqq 20 \quad 6 \leqq m + n$

4.

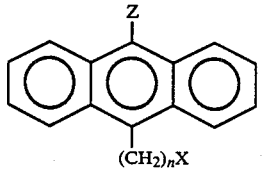

$Z = CN, F, Cl \quad 6 \leqq n \leqq 20$

-continued

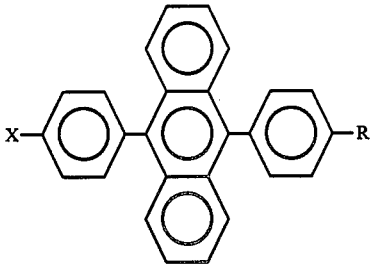

6.

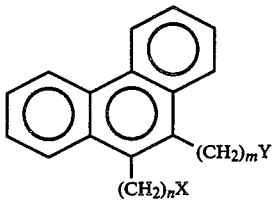

$0 \leqq m, n \leqq 20 \quad 6 \leqq m + n$

7.

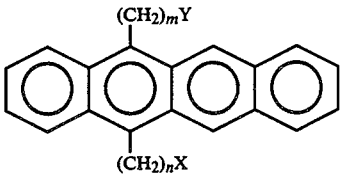

$0 \leqq m, n \leqq 20 \quad 3 \leqq m + n$

8.

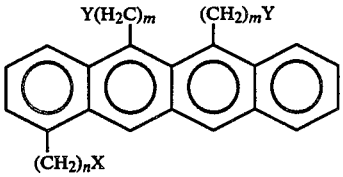

$0 \leqq m, n \leqq 20 \quad 3 \leqq m + n$

9.

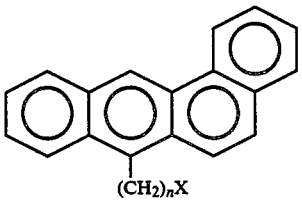

$3 \leqq n \leqq 20$

10.

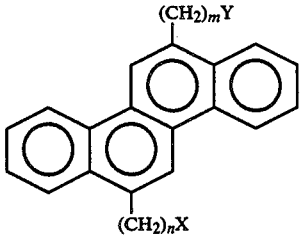

$0 \leqq m, n \leqq 20 \quad 3 \leqq m + n$

11.

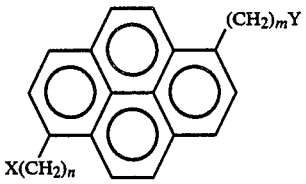

$0 \leqq m, n \leqq 20 \quad 3 \leqq m + n$

-continued

12.

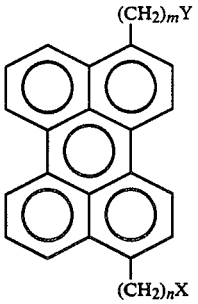

$0 \leqq m, n \leqq 20 \quad 3 \leqq m + n$

13.

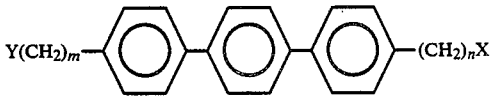

$0 \leqq m, n \leqq 20 \quad 6 \leqq m + n$

14.

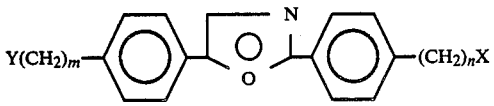

$0 \leqq m, n \leqq 20 \quad 6 \leqq m + n$

15.

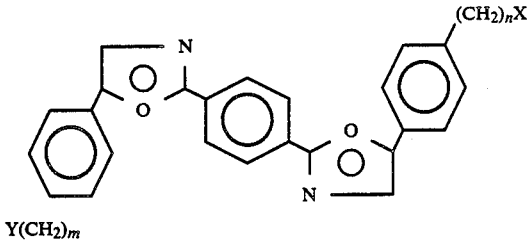

$0 \leqq m, n \leqq 20 \quad 6 \leqq m + n$

16.

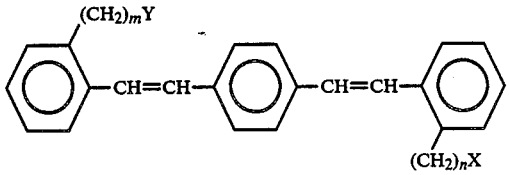

$0 \leqq m, n \leqq 20 \quad 6 \leqq m + n$

17.

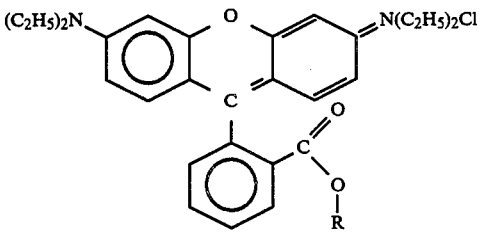

18.

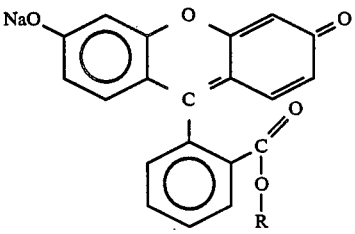

-continued
19.
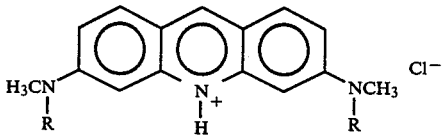
20.
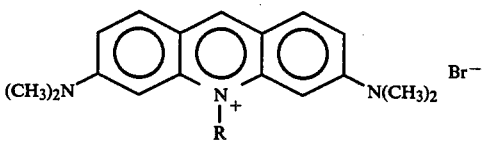
21.
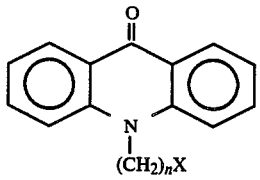
$6 \leqq n \leqq 20$
22.
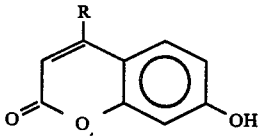
23.
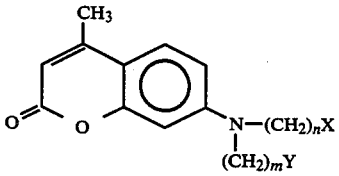
$0 \leqq m, n \leqq 20 \quad 6 \leqq m + n$
24.
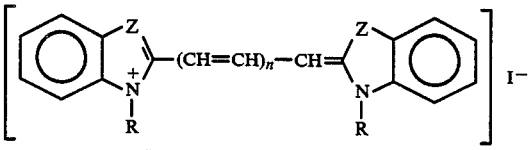
$Z = O, S, Se \quad 0 \leqq n \leqq 2$
25.
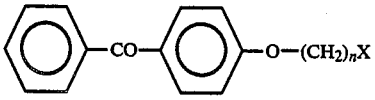
$6 \leqq n \leqq 20$
26.
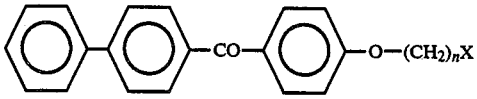
$6 \leqq n \leqq 20$
27.
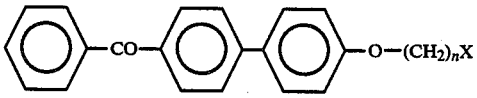
$6 \leqq n \leqq 20$
28.
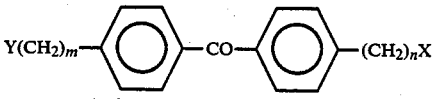
$0 \leqq m, n \leqq 20 \quad 6 \leqq m + n$
-continued
29.
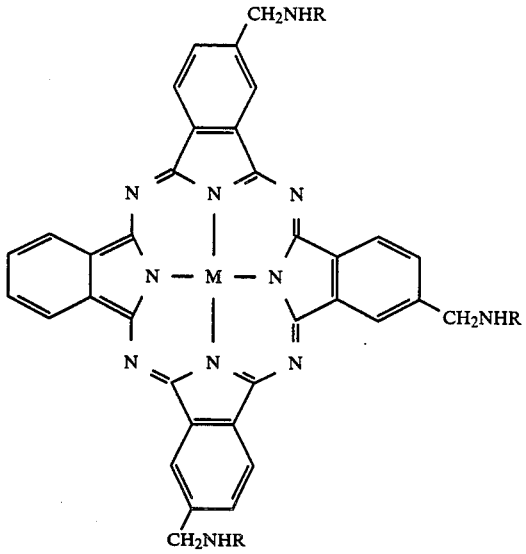
$M = Mg, Zn, Sn, AlCl$
30.
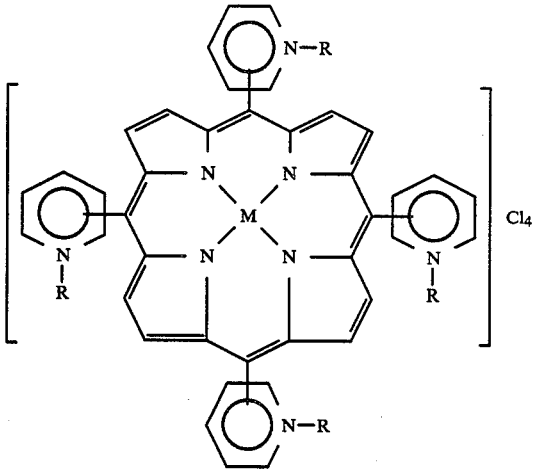
$M = H_2, Be, Mg, Ca, Cd, Sr \quad AlCl, YbCl$
31.
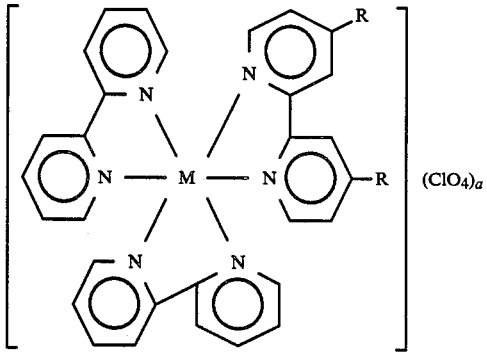
a,M = Ru, a = 2 b,M = Er, Tm, Sm, Eu, Tb, a = 3
32.
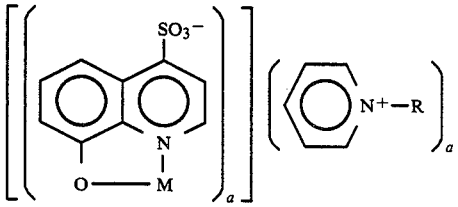

-continued
M = Al, Ga, Ir, Ta, a = 3
M = An, Cd, Mg, Pb, a = 2
33.
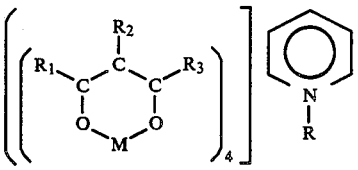
M = Er, Sm, Eu, Gd, Tb, Dy, Tm, Yb
$R_1$, $R_2$ $R_6$ = 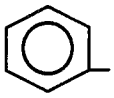 , 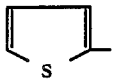 , $-CF_3$, H
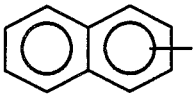 , $-CH_3$, $-$t-Bu
34.
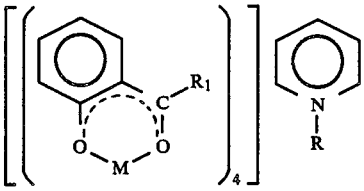
M = Er, Sm, Eu, Gd, Tb, Dy, Tm, Yb
$R_1$ = H, $-CH_3$, $-CF_3$, 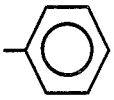
35.
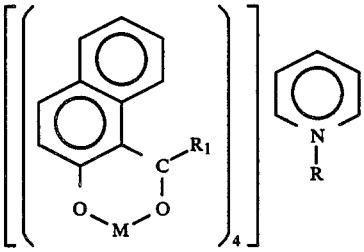
M = Er, Sm, Eu, Gd, Tb, Dy, Tm, Yb
$R_1$ = H, $-CH_3$, $-CF_3$, 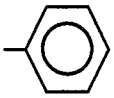
36.
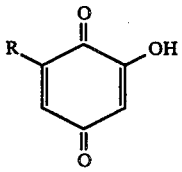
37.
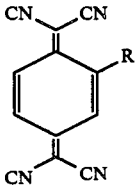
38.
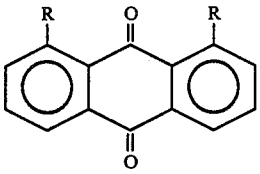
39.
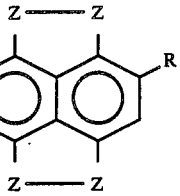
Z = S, Se
40.
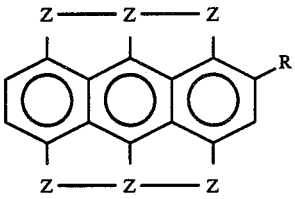
Z = S, Se
41.
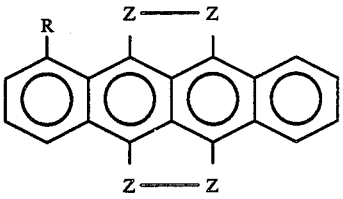
Z = S, Se
42.
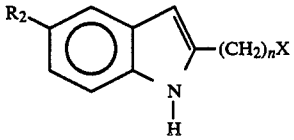
43.
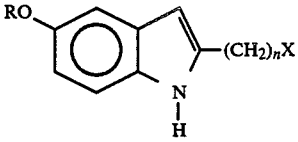
44.
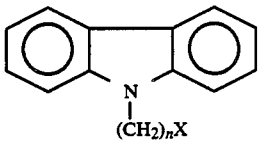
45.
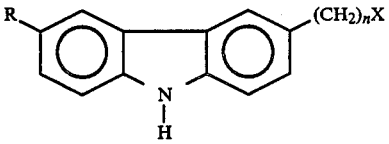
46.
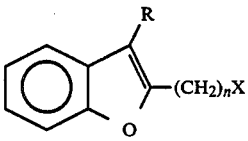

-continued
47.
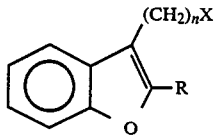
48.
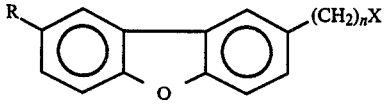
49.
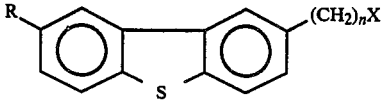
50.
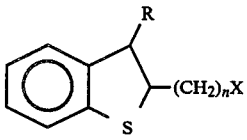
51.
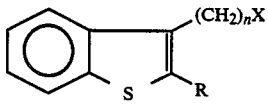
52.
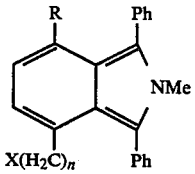
53.
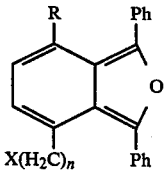
54.
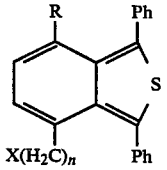
55.
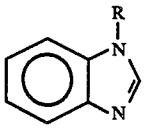
56.
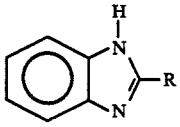
57.
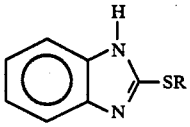
-continued
58.
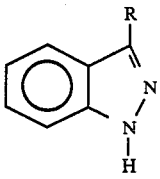
59.
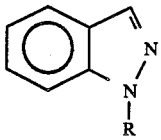
60.
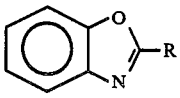
61.
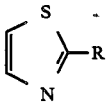
62.
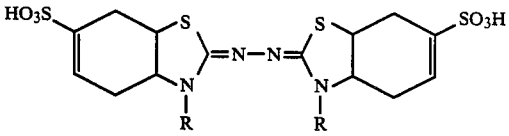
63.
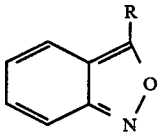
64.
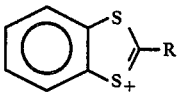
65.
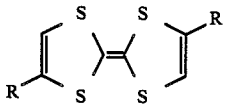
66.
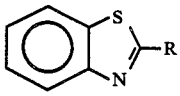
67.
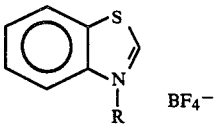
68.
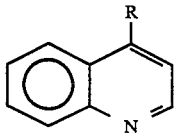

-continued
69.
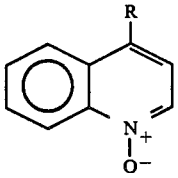
70.
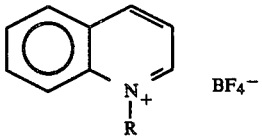
71.
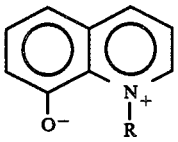
72.
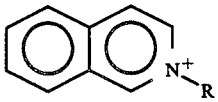
73.
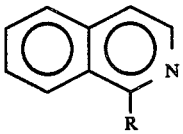
74.
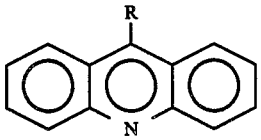
75.
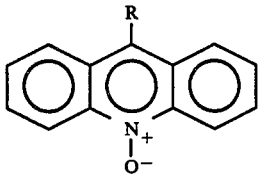
76.
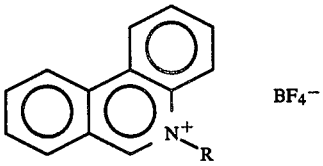
77.
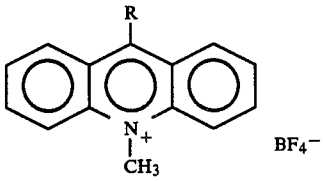
-continued
78.
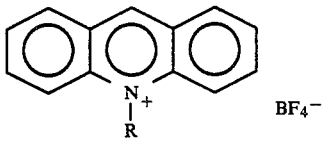
79.
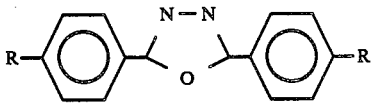
80.
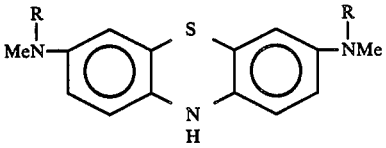
81.
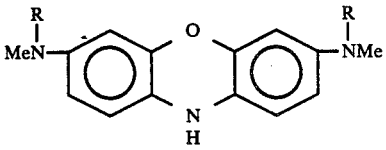
82.
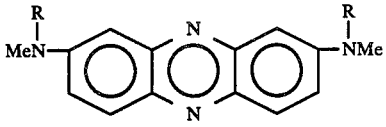
83.
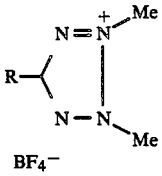
84.
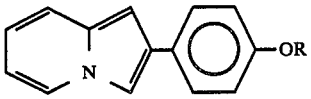
85.
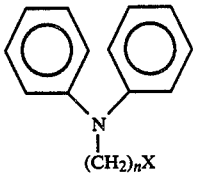
86.
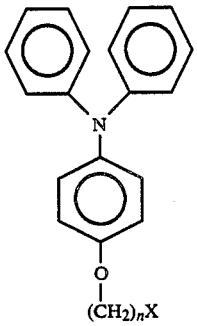

-continued

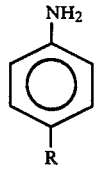

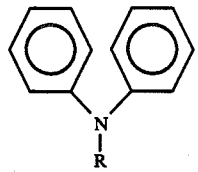

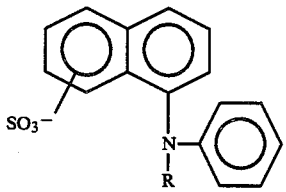

The compounds for forming the monomolecular film represented by the structural formulae No. 1–No. 35 are obtained by modifying, using a hydrophobic group and/or hydrophilic group, the compounds having EL function resulting from formation of an excited complex among the compounds capable of forming a functional portion as mentioned above. The compounds of the structural formulae No. 42–No. 54 and No. 85–No. 86 have such structure that an alkyl chain is linked directly with the functional portion. Also the alkyl chain may be linked with the functional portion through, for example, an ether linkage, a carbonyl group or the like.

The compounds which can be applied to a thin film-forming method such as vapor deposition and the like among the compounds as mentioned above can also be used for forming a thin film layer excluding the monomolecular film and monomolecular built-up film. The above thin film layer may be composed of two or more of the compounds in a way similar to the layer constitution of the monomolecular film and nonomolecular built-up film as described above. In such a case, the first layer may be formed by combining two or more of the compounds having the functional portion, if necessary, further by adding another component to increase the strength of the first layer and to improve adhesion to other layers.

The third layers 4 - 1, 4 - 2 and 4 - 3 constituting the luminescent layer in the EL device of the present invention have an insulation property. Especially, the third layers 4 - 1 and 4 - 3 have the function for enhancing an insulation property of the condensed structure of the EL device of the present invention, and layer 4 - 2 has the function for confining electrons within a minimum to be required and generating efficient luminescence resulting from donating and accepting efficiently electrons. As the materials capable of constituting these layers, there may be mentioned the compounds capable of forming a monomolecular layer having a precise and uniform insulation property or the like represented by the following general formulae;

87. $CH_3-(CH_2)_n-X$, or $CH_2OCO-(CH_2)_n-CH_3$ | $CHOCO-(CH_2)_n-CH_3$ | $CH_2OCO-(CH_2)_n-CH_3$ (wherein n is $10 \leqq n \leqq 30$, and X is a group of —COOH, —$CONH_2$, —COOR, —$N^+(CH_3)_3.Cl^-$,

88.

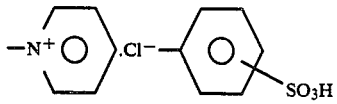

or the like.)

89. The third layer may be composed of the monomolecular film or the monomolecular built-up film. In the case of the monomolecular built-up film, each monomolecular film may be the same, or one or more of the monomolecular films may be different from other monomolecular films in the built-up film. Further, the third layer may be the monomolecular film comprising one compound, or a multicomponent type monomolecular film comprising two or more compounds. In the case of the third layer excluding the monomolecular and monomolecular built-up film, the layer can be formed with one or more of the above materials by a thin film-forming method such as a vapor deposition method, CVD method and the like.

Illustrated as follows is a typical operation of a monomolecular built-up method represented by Langmuir-Blodgett method (LB method) applied to formation of the luminescent layer of the EL device of the present invention.

A cleaned substrate is immersed in the water phase for formation of the monomolecular film in the water bath. Next, a predetermined volume of the solution of the compound for forming the monomolecular film dissolved or dispersed in the suitable solvent is spread on the surface of the water to form a compound film, that is, a monomolecular film. At this time, a partition plate (or float) is provided so that the monomolecular film may not be freely and too widely diffused on the water surface, and the aggregation state of the film-forming material is controlled by restricting the spread area to obtain a surface pressure $\pi$ proportinal to the aggregation state. The partition plate is moved to narrow the spread area and raise gradually the surface pressure $\pi$ to the suitable value for the formation of the monomolecular film. By gently moving up and down the substrate in the direction vertical to the water surface while maintaining this surface pressure $\pi$, the monomolecular film is transferred to the substrate every upward movement and every downward movement, thereby forming the monomolecular built-up film. The monomolecular film can be transferred to the substrate not only by the vertical dipping method but also by the various methods as follows:

(1) The horizontal lifting method which is to transfer the monomolecular film by contacting horizontally a substrate with the water surface;

(2) The cylinder rotation method which is to transfer the monomolecular film to the surface of the cylindrical substrate by rotating the substrate on the water surface;

(3) The method by which the substrate is pushed out into water from a substrate roll.

The above methods are mentioned as examples. In the case of the vertical dipping method, a Y-type film is formed since the orientation of the film-forming molecules is reversed between pulling-up and dipping processes. In the case of the horizontal lifting method, an X-type film is formed as the built-up film, since hydrophobic group is oriented toward the substrate. However, such an orientation of the hydrophilic group and the hydrophobic group may be changed by surface treatment of the substrate or the like.

During formation of the monomolecular film or the monomolecular built-up film constituting the luminescent layer of the EL device of the present invention by the monomolecular built-up method, the operation conditions such as pH of the water, the kind and volume of additives for controlling pH and the like of the water, temperature of the water, the rate of moving up and down the substrate, surface pressure and the like are optionally determined according to the kind of the monomolecular film-forming compounds to be used and the characteristics of the film to be formed.

Illustrated above by referring to FIG. 1 is the EL device of the present invention having two interfaces, that is, the interface formed by the first layer 5 - 1 and the second layer 6 - 1 and the interface formed by the first layer 5 - 2 and the second layer 6 - 2.

The number of the above interfaces in the EL device of the present invention are not to be construed as being limitative of the above, that is, the two interfaces. Therefore, the EL device having three or more of the above interfaces may be also fabricated. A thickness of each layer constituting the luminescent layer in the EL device of the present invention being the constitution as shown above may depend on the number of the interfaces in the EL device and each layer type. In the case where each layer is formed by the LB method to form the monomolecular film or the monomolecular built-up film, its thickness is 300 Å or less, preferably 100 Å or less.

In the case where each layer is formed by other methods, its thickness is 500 Å or less, preferably 200 Å or less. Further, it is desired to generate good luminescent state in low voltage driving that a thickness of the whole of the luminescent layer is 1 μm or less, preferably 3000 Å or less.

In the case where a transparent electrode layer is formed $I_nO_2$, $S_nO_2$, indium-tin-oxide(I.T.O.) or the like can be deposited on a transparent substrate, for example, a film or sheet such as PMMA, polyester and the like or a glass plate, or directly on the luminescent layer by a vapor deposition method or the like.

In the case of an opaque electrode, Al, Ag, Au or the like can be deposited on a suitable substrate or a thin plate composed of a material capable of forming a general electrode having sufficient conductivity, or directly on the luminescent layer by a vapor deposition method or the like.

A thickness of these electrode layers is about 0.01 μm–0.3 μm, preferably about 0.05 μm–0.2 μm.

The EL device of the present invention may be formed into various shapes and sizes as desired. For example, a substrate on which the transparent electrode is formed is used as the substrate for forming the luminescent layer, and this substrate of plate shape, belt shape or cylinder shape is formed into desired shape and size. The transparent and opaque electrode layers may be patterned into various shapes as desired.

A direct current, an alternating current, or a pulse voltage is applied to the EL device of the present invention of a constitution as illustrated above so that an electric field of about $1\times10^5-3\times10^6$ V/cm occurs between the electrodes 1 and 2 of the EL device, for example, in the luminescent layer 3. Thereby, good luminescence from the luminescent layer 3 can be generated through the transparent electrode.

By using the monomolecular built-up method or, if desired, using another thin film-forming method in combination therewith, for example, the luminescent layers of the present invention may be formed as described below ((1)–(7)).

(1) First, the third layer composed of the monomolecular film or the monomolecular built-up film of the desired constitution is formed with the material for forming the third layer as described above on the substrate as described above on which the transparent electrode layer is formed. Next, with the material capable of forming the first layer and the second layer as described above, the first layer and the second layer composed of the monomolecular film or the monomolecular built-up film of the desired constitution are successively formed on the third layer formed previously.

Further, the third layer is formed on the second layer. The operation for forming the layers from the first layer to the third layer is repeated two times or more according to the desired number of the interfaces formed by the first layer and the second layer.

(2) The desired third layer is formed with the material for forming the third layer as described above by a vapor deposition method or the like on the substrate as described above on which the transparent electrode layer is formed. Next, with the material capable of forming the first layer and the second layer as described above, the first layer and the second layer composed of the monomolecular film or the monomolecular built-up film of the desired constitution are successively formed on the third layer formed previously.

Further, the third layer is formed on the second layer. The operation for forming the layers from the first layer to the third layer is repeated two times or more according to the desired number of interfaces formed by the first layer and the second layer.

(3) The third layer composed of the monomolecular film or the monomolecular built-up film of the desired constitution is formed with the material for forming the third layer as described above on the substrate on which the transparent electrode layer is formed. Next, the first layer of the desired constitution is formed with the material capable of forming the first layer as described above by a vapor deposition method or the like on the above third layer, and then, the second layer composed of the monomolecular film or the monomolecular built-up film of the desired constitution is formed with the material capable of forming the second layer as described above on the above first layer.

Further, the third layer is formed on the second layer. The operation for forming the layers from the first layer to the third layer is repeated two times or more according to the desired number of the interfaces formed by the first layer and the second layer.

(4) The third layer composed of the monomolecular film or the monomolecular built-up film of the desired constitution is formed with the material for forming the third layer as described above on the substrate on which the transparent electrode layer is formed. Next, the first layer composed of the monomolecular film or the monomolecular built-up film of the desired constitution is formed with the material capable of forming the first layer as described above on the above third layer, and then, the second layer of the desired constitution is formed with the material capable of forming the second layer as described above by a vapor deposition method or the like on the above first layer.

Further, the third layer is formed on the second layer. The operation for forming the layers from the first layer to the third layer is repeated two times or more according to the desired number of the interfaces formed by the first layer and the second layer.

(5) The third layer of the desired constitution is formed with the material for forming the third layer as described above by a vapor deposition method or the like on the substrate as described above on which the transparent electrode layer is formed. Next, the first layer composed of the monomolecular film or the monomolecular built-up film of the desired constitution is formed with the material capable of forming the first layer as described above on the above third layer, and then, the second layer of the desired constitution is formed with the material capable of forming the second layer as described above by a vapor deposition method or the like on the above first layer.

Further, the third layer is formed on the second layer. The operation for forming the layers from the first layer to the third layer is repeated two times or more according to the desired number of the interfaces formed by the first layer and the second layer.

(6) The third layer of the desired constitution is formed with the material for forming the third layer as described above by a vapor deposition method on the substrate on which the transparent electrode layer is formed. Next, the first layer of the desired constitution is formed with the material capable of forming the first layer as described above by a vapor deposition method or the like on the above third layer, and then, the second layer composed of the monomolecular film or the monomolecular built-up film of the desired constitution is formed with the material capable of forming the second layer as described above on the above first layer.

Further, the third layer is formed on the second layer. The operation for forming the layers from the first layer to the third layer is repeated two times or more according to the desired number of the interfaces formed by the first layer and the second layer.

(7) The third layer composed of the monomolecular film or the monomolecular built-up film of the desired constitution is formed with the material for forming the third layer as described above on the substrate on which the transparent electrode layer is formed. Next, the first layer of the desired constitution is formed with the material capable of forming the first layer as described above by a vapor deposition method or the like on the above third layer, and then, the second layer of the desired constitution is formed with the material capable of forming the second layer as described above by a vapor deposition method or the like on the above first layer.

Further, the third layer is formed on the second layer. The operation for forming the layers from the first layer to the third layer is repeated two times or more according to the desired number of interfaces formed by the first layer and the second layer.

Finally, on these third layers, metals such as Al, Ag, Au and the like can be deposited by a vapor deposition method or the like to form the EL devices of the present invention.

In the case where an opaque electrode plate or a substrate having an opaque electrode layer is used for forming the luminescent layer thereon, the material such as I.T.0. and the like for forming the transparent electrode layer may be deposited by a vapor deposition method or the like on the luminescent layer formed on the above substrate. In the case where both of the two electrodes are transparent, the transparent electrode layer is formed with the above-mentioned material on the transparent substrate for forming the luminescent layer, and after formation of the luminescent layer, the transparent electrode layer may be formed on the above luminescent layer.

Each of the first layers constituting the luminescent layer in the EL device of the present invention may have the same constitution. One or more of the first layer may differ from other first layers in the constitution. It is the same with the second and third layer. An adhesive layers may be provided for enhancing the adhesiveness between each of the layers constituting the EL device of the present invention. Further, the EL device of the present invention may have desirably a structure to be protected from moisture and oxygen in air.

The EL device of the present invention as described above generates mainly the luminescence in the interface formed by the two layers different in electrochemical property to each other. The plural interfaces are provided perpendicularly to the generation direction of the light in the EL device. The quantity of the luminescence per the unit of the light-generating area could be extremely increased as compared with a conventional EL device.

Further, the EL device of the present invention having the plural interfaces for the luminescence enables control of the luminescent color, as desired, by combining the adjacent layers forming the interface, each having different constitution one from the other.

The luminescent layer in the EL device of the present invention is mainly formed with the organic compound materials by a method for forming the thin film suitable to the above materials. Especially, although the luminescent layer is the multilayer structure having the plural interfaces for the luminescence, the whole luminescent layer may be thinly formed by composing at least one of the layers constituting the luminescent layer of the monomolecular film or the monomolecular built-up film. Thereby, the efficient luminescent state and the sufficient intensity of the light are obtained in the low voltage driving.

In the case were the layer participating directly in the luminescence in the EL device of the present invention is composed of the monomolecular film or the monomolecular built-up film, the more efficient luminescence resulting from formation of an excited complex caused by donating and accepting electrons becomes possible, since the functional portion of the compound participating directly in the luminescence is regularly oriented and arranged with precision toward the interface. The monomolecular film may be formed at ordinary temperature and pressure. Further, as a constitution material of each layer in the luminescent layer, there may be used an organic compound weak to heat which is not suitable to the vapor deposition method or the like.

Each layer in the luminescent layer in the EL device of the present invention may be formed as a thin film good in precision with a variety of organic compound materials. Although the EL device of the present invention is a large area, the luminescent layer has good precision and a good function. Further, the EL device may be sold at a low price and produced in large quantities. The electroluminescent device of the present invention are explained in detail according to the following Examples.

EXAMPLE 1a

A transparent electrode plate 44 (FIG. 4) was formed by vapor-depositing an ITO layer of 1500Å thick on a glass plate of 50 mm square according to a sputtering method. The electrode plate was dipped into an aqueous phase (pH 6.5) in Langmuir-Trough 4 (tradename produced by Joyce-Loebel Co., Ltd.) in which a concentration of $CdCl_2$ was $4\times10^{-4}$ (mol/l).

Next, arachidic acid was dissolved in chloroform to a concentration of $1\times10^{-3}$ mol/l. 0.5 ml of the resulting solution was spread on the aqueous phase. After removal of chloroform from the surface of the aqueous phase by evaporation, the surface pressure was regulated to 30 dynes/cm, and an arachidic acid film was formed on the surface of the aqueous phase.

Further, while keeping the surface pressure constant, the electrode plate was carefully pulled up at a rate of 2 cm/min at right angles to the surface of the aqueous phase, and thereby an insulating layer as the third layer which comprised a monomolecular film of arachidic acid was formed on the electrode layer of the electrode plate. Then, the resulting plate was pulled up out of the aqueous phase and allowed to stand for 30 minutes or more at room temperature to dryness.

The arachidic acid remaining on the surface of the surface of the aqueous phase was completely removed from the surface of the aqueous phase, and the electrode plate provided with the monomolecular insulating layer consisting of arachidic acid was dipped again into the aqueous phase. A fresh chloroform solution (0.5 ml) which contained the following compound,

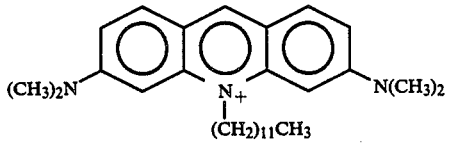

at a concentration of $1\times10^{-3}$ mol/l was spread on the surface of the aqueous phase, the surface pressure was adjusted to 30 dynes/cm, and the electrode plate was carefully pulled up at a rate of 2 cm/min at right angle to the surface of the aqueous phase. Thus, a monomolecular film of the above-mentioned compound as the second layer was formed on the insulating layer. The resulting electrode plate was pulled up out of the aqueous phase and allowed to stand for 30 minutes or more at room temperature to dryness.

Further, the above compound remaining on the surface of the aqueous phase was completely removed from the surface of the aqueous phase, and the electrode plate was dipped. A fresh chloroform solution (0.5 ml) which contained the following compound,

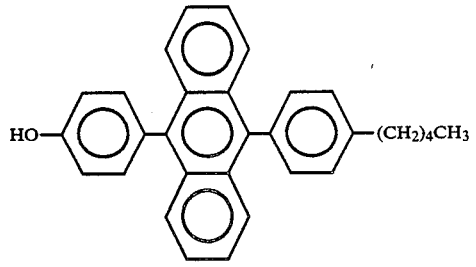

at a concentration of $1\times10^{-3}$ mol/l was spread on the surface of the aqueous phase, the surface pressure was adjusted to 30 dynes/cm, and the electrode plate was carefully pulled up at a rate of 2 cm/min. at right angles to the surface of the aqueous phase. Thus, a monomolecular film of the above compound as a first layer was formed on the second layer.

Thereafter, the forming operation of the third layer to the first layer was repeated four times, and finally, the third layer was laminated thereon. Thus, a luminescent layer (layer thickness; ca. 400Å) having four interfaces between the first layer and the second layer was formed.

The electrode plate on which an electroluminescent layer was formed as above was placed in a vapor-deposition chamber, and the inner pressure of the chamber was reduced to $10^{-6}$ Torr. Further, while regulating the pressure to $10^{-5}$ Torr, aluminum was vapor-deposited in the thickness of 1500Å at a vapor deposition rate of 20Å/sec onto the third layer formed latest. Thus, an electroluminescent device 40 of the present invention which had a back electrode 45 formed as above was prepared.

Figure 4:
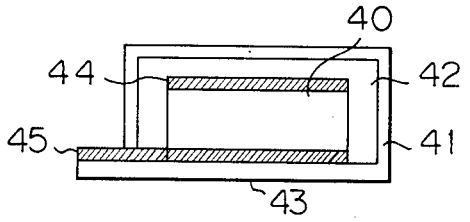

As shown in FIG. 4, the electroluminescent device was sealed with sealing-glasses 41. Then, according to a conventional manner, silicon oil 42 which was refined, deaerated and dehydrated was injected into a space between the electroluminescent device and the sealing-glass, to give an electroluminescent cell 43.

Such electrodes 44 and 45 of the EL cell were impressed with alternating voltage (10 V, 400 Hz) to give luminescence. The luminance and the current density were measured. The results are shown in Table 1a.

EXAMPLES 2a–4a

Repeating the procedure in Example 1a except that the forming operation of the third layer to the first layer was repeated eight times in Example 2a, twelve times in Example 3a and sixteen times in Example 4a, electroluminescent devices were prepared which had eight interfaces between the first layers and the second layers in Example 2a, twelve interfaces in Example 3a and sixteen interfaces in Example 4a, respectively. Further, using the above devices, electroluminescent cells were prepared.

The electroluminescent cells each were light-emitted as in Example 1a, the luminances and current densities at that time were measured. The results were shown in Table 1a.

EXAMPLE 5a

A transparent electrode plate 44 (FIG. 4) was formed by vapor-depositing an ITO layer of 1500Å thick on a glass plate of 50 mm square according to a sputtering method. The electrode plate was dipped into an aqueous phase (pH 6.5) in Langmuir-Trough 4 (tradename, produced by Joyce-Loebel Co., Ltd.) in which a concentration of cadmium chloride was $4\times10^{-4}$ mol/l.

Next, arachidic acid was dissolved in chloroform to a concentration of $1\times10^{-3}$ mol/l. The resulting solution (0.5 ml) was spread on the surface of the aqueous phase. After removal of chloroform from the surface of the aqueous phase by evaporation, the surface pressure was regulated to 30 dynes/cm, and an arachidic acid film was formed on the surface of the aqueous phase.

Further, while dipping the surface pressure constant, the electrode plate was pulled up and immersed carefully at a rate of 2 cm/min at right angles to the surface of the aqueous phase. The above operation was repeated twice, whereby the third layer as an insulating layer which comprised four built-up monomolecular films of arachidic acid was formed on the electrode layer. The resulting plate was pulled up out of the aqueous phase and allowed to stand for 30 minutes or more at room temperature to dryness.

The arachidic acid remaining on the surface of the aqueous phase was removed completely from the surface of the aqueous phase, and the monomolecular insulating layer was dipped again into the aqueous phase. A fresh chloroform solution (0.5 ml) which contained the following compound

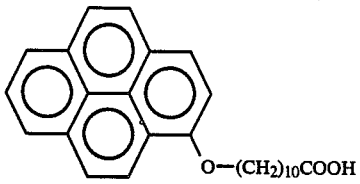

at a concentration of $1\times10^{-3}$ mol/l was spread on the surface of the aqueous phase, the surface pressure was regulated to 30 dynes/cm, and the electrode plate was pulled up carefully at a rate of 2 cm/min at right angles to the surface of the aqueous phase, further immersed and pulled up, whereby the first layer which comprised three built-up monomolecular films of the following compound was formed on the insulating layer. Then, the electrode plate was pulled up out of the aqueous phase and allowed to stand for 30 minutes or more at room temperature to dryness.

Further, there was removed completely the above compound remaining on the surface of the aqueous phase, the electrode plate was dipped again into the aqueous phase. The following compound was dissolved in chloroform to a concentration of $1\times10^{-3}$ mol/l.

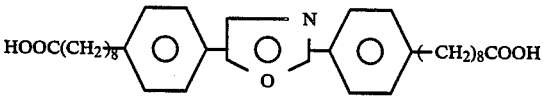

The resulting chloroform solution (0.5 ml) was spread on the surface of the aqueous phase, the surface pressure was regulated to 30 dynes/cm. The electrode plate was pulled up carefully at a rate of 2 cm/min at right angle to the surface of the queos phase, further immersed and pulled up. Thereby, the second layer comprising three built-up monomolecular films of the above-mentioned compound was formed on the first layer.

Thereafter, the forming operation of the third layer to the first layer was repeated four times, and finally, the third layer was laminated thereon. Thus, a luminescent layer (layer thickness; ca. 1000Å) having four interfaces between the first layers and the second layers was formed.

The resulting electrode plate having an electroluminescent layer thus formed was placed in a vapor deposition chamber, and an inner pressure of the chamber was reduced to $10^{-6}$ Torr. Further, while regulating the pressure to $10^{-5}$ Torr, aluminum was vapor-deposited in the thickness of 1500Å at a rate of 20Å/sec onto the third layer formed finally. Thus, an electroluminescent device 40 of the present invention which has a back electrode formed as above was prepared.

As shown in FIG. 4, the electroluminescent device was sealed with sealing-glasses 41. Then, according to a conventional manner, silicon oil 42 which was refined, deaerated and dehydrated was injected into a space between the electroluminescent device and the sealing-glass, to afford an electroluminescent cell 43.

Such electrodes 44 and 45 were inpressed with alternating voltage (10 V, 400 Hz) to give luminescene. The lumineance and the current density were measured. The results are shown in Table 1a.

| | Number of interface | Drive voltage | Luminance (fL) | Current density (mA/cm$^2$) |
|---|---|---|---|---|
| Example 1a | 4 | 10 V, 400 Hz | 5.1 | 0.11 |
| Example 2a | 8 | 10 V, 400 Hz | 18 | 0.10 |
| Example 3a | 12 | 10 V, 400 Hz | 23 | 0.10 |
| Example 4a | 16 | 15 V, 400 Hz | 32 | 0.08 |
| Example 5a | 4 | 10 V, 400 Hz | 25 | 0.08 |

EXAMPLE 1b

A transparent electrode plate 44 (FIG. 4) was formed by vapor-depositing an ITO layer of 1500Å thick on a glass plate of 50 mm square according to a sputtering method.

The electrode plate was set on a given place in a vapor-deposition chamber of a resistance heating vapor-deposition apparatus, and then methyl stearate (m.p. 38° C.) was placed in the resistance heating boat. The inner pressure of the chamber was reduced to $10^{-6}$ Torr, and a current flowing through the boat so that the vapor-deposition rate was 2Å/sec. Thus, a vapor-deposition layer as the third layer thich comprised methyl stearate layer of 200Å thick was formed on the transparent electrode layer of the electrode plate. Further, while vapor-depositing, the vacuum pressure was $9\times10^{-6}$ Torr, and the temperature of the substrate holder was 20° C.

The electrode plate was dipped into an aqueous phase (pH6.5) in Langmuir-Trough 4 (tradename, produced by Joyce-Loebel Co., Ltd.) in which a concentration of cadmium chloride was $4\times10^{-4}$ mol/l.

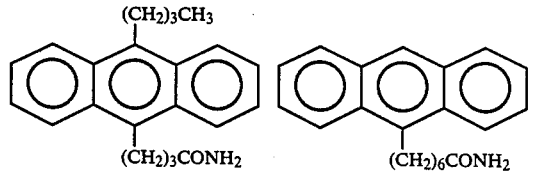

Next, the above two compounds were dissolved in chloroform at mole ratio of 1:1 so that the total concentration was $10^{-3}$ mol/l. The resulting solution (0.5 ml) was spread on the aqueous phase, the surface pressure was regulated to 30 dynes/cm, and a multi-component monomolecular film of the above two compounds was formed on the surface of the aqueous phase. The electrode plate was then pulled up and dipped carefully (the rate of moving vertically was 2 cm/min) at right angle to the surface of the aqueous phase. By repeating the above-mentioned operation twice, a monomolecular built-up film as the second layer comprising four monomolecular layers of the mixture of the above compounds was formed on the third layer formed previously. Then, the electrode plate was pulled up out of the aqueous phase and allowed to stand for 30 minutes or more at room temperature to dryness.

Further, there was removed completely the above compounds remaining on the surface of the aqueous phase, and the electrode plate was dipped again into the aqueous phase.

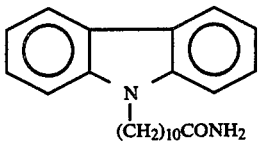

The above compound was newly dissolved in chloroform to a concentration of $1\times10^{-3}$ mol/l. The resulting solution (0.5 ml) was spread on the surface of the aqueous phase, the surface pressure was regulated to 30 dyne/cm, and a monomolecular film of the above compound was formed on the surface of the aqueous phase. The electrode plate was pulled up carefully at a rate of 2 cm/min at right angle to the surface of the aqueous phase, further immersed and pulled up. Thus, the monomolecular built-up film as the first layer comprising three monomolecular layers of the above compound was formed on the second layer formed previously.

Thereafter, the forming operation of the third layer to the first layer was repeated four times, and finally, the third layer was laminated thereon. Thus, a luminescent layer (layer thickness; ca. 1700Å) having four interfaces between the first layers and the second layers was formed.

The electrode plate on which a luminescent layer was formed as above was placed in a vapor-deposition chamber, and an inner pressure of the chamber was reduced to $10^{-6}$ Torr. Further, while regulating the pressure to $10^{-5}$ Torr, aluminum was vapor-deposited in the thickness of 1500Å at a vapor-deposition rate of 20Å/sec onto the third layer formed latest. Thus, an electroluminescent device 40 of the present invention which had a back electrode 45 formed as above was prepared.

As shown in FIG. 4, the electroluminescent device was sealed with sealing- glasses 41. Then, according to a conventional manner, silicone oil 42 which was refined, deaerated and dehydrated was injected into a space between the electroluminescent device and the sealing-glass, to afford an electroluminescent cell 43.

Such electrodes 44 and 45 were impressed with alternating voltage (10 V, 400 Hz) to give luminescence. The luminance and the current density were measured. As the result, the luminance was 20 fL at current density of 0.08 mA/cm$^2$.

EXAMPLE 1c

A transparent electrode plate 44 (FIG. 4) was formed by vapor-depositing an ITO layer of 1500Å thick on a glass plate of 50 mm square according to a sputtering method. The electrode plate was dipped into an aqueous phase (pH6.5) in Langmuir-Trough 4 (tradename, produced by Joyce-Loebel Co., Ltd.) in which the concentration of $CdCl_2$ was $4\times10^{-4}$ (mol/l).

Next, stearic acid was dissolved in chloroform to a concentration of $1\times10^{-3}$ mol/l. The resulting solution of 0.5 ml was spread on the aqueous phase. After removal of chloroform from the surface of the aqueous phase by evaporation, the surface pressure was regulated to 30 dynes/cm, and stearic acid film was formed on the surface of the aqueous phase.

Further, while keeping the surface pressure constant, the electrode plate was carefully pulled up at a rate of 2 cm/min at right angle to the surface of the aqueous phase, and whereby an insulating layer as the third layer which was a monomolecular film of stearic acid was formed on the electrode layer of the electrode plate. Then, the resulting plate was pulled up out of the aqueous phase and allowed to stand for 30 minutes or more at room temperature. Further, by repeating this operation, a monomolecular built-up film as the third layer comprising three built-up monomolecular films of stearic acid molecules was formed on the electrode layer of the electrode plate. The stearic acid remaining on the surface of the aqueous phase was removed completely from the surface of the aqueous phase.

The electrode plate was set at a given place in a vapor-deposition chamber of a resistance heating vapor-deposition apparatus, and then anthracene (m.p. 216° C.) was placed in the resistance heating boat. The inner pressure of the chamber was reduced to $10^{-6}$ Torr, and a current flowing through the boat was controlled so that the vapor-deposition rate was 2Å/sec. Thus, a vapor-deposition layer as the first layer comprising anthracene layer of 200Å thick was formed on the insulating layer as the third layer formed previously. Further, while vapor-depositing, the vacuum pressure was $9\times10^{-6}$ Torr, and the temperature of the substrate holder was 20° C.

After formation of the first layer as above, the electrode plate was dipped again into the aqueous phase which was used for forming the third layer, and the remaining stearic acid had already been removed completely from the surface of the aqueous phase before dipping again.

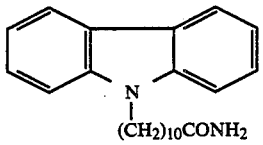

The above compound was newly dissolved in chloroform to a concentration of $1\times10^{-3}$ mol/l. The resulting solution (0.5 ml) was spread on the surface of the aqueous phase, the surface pressure was regulated to 30 dyne/cm, and a monomolecular film of the above compound was formed on the surface of the aqueous phase. The electrode plate was pulled up carefully at a rate of 2 cm/min at right angle to the surface of the aqueous phase, further immersed and pulled up. Thus, the monomolecular built-up film as the second layer comprising three monomolecular layers of the above compound was formed on the first layer formed previously. Then, the electrode plate was pulled up out of the aqueous phase and allowed to stand for 30 minutes or more at room temperature to dryness.

Thereafter, the forming operation of the third layer to the second layer was repeated four times, and finally, the third layer was laminated thereon. Thus, a luminescent layer (layer thickness; ca. 1500Å) having four interfaces between the first layers and the second layers was formed.

The electrode plate on which a luminescent layer was formed as above was placed in a vapor-deposition chamber, and an inner pressure of the chamber was reduced to $10^{-6}$ Torr. Further, while regulating the pressure to $10^{-5}$ Torr, aluminum was vapor-deposited in the thickness of 1500Å at a vapor-deposition rate of 20Å/sec onto the third layer formed latest. Thus, an electroluminescent device 40 of the present invention which had a back electrode 45 formed as above was prepared.

As shown in FIG. 4, the electroluminescent device was sealed with sealing-glasses 41. Then, according to a conventional manner, silicone oil 42 which was refined, deaerated and dehydrated was injected into a space between the electroluminescent device and the sealing-glass, to provide an electroluminescent cell 43.

Such electrodes 44 and 45 were impressed with alternating voltage (20 V, 400 Hz) to give luminescence. The luminance and the current density were measured. As the result, the luminance was 26 fL at current density of 0.12 mA/cm$^2$.

EXAMPLE 1d

A transparent electrode plate 44 (FIG. 4) was formed by vapor-depositing an ITO layer of 1500Å thick on a glass plate of 50 mm square according to a sputtering method. The electrode plate was dipped into an aqueous phase (pH 6.5) in Langmuir-Trough 4 (tradename, produced by Joyce-Loebel Co., Ltd.) in which a concentration of $CdCl_2$ was $4\times10^{-4}$ (mol/l).

Next, stearic acid was dissolved in chloroform to a concentration of $1\times10^{-3}$ mol/l. The resulting solution of 0.5 ml was spread on the aqueous phase. After removal of chloroform from the surface of the aqueous phase by evaporation, the surface pressure was regulated to 30 dyne/cm, and a stearic acid film was formed on the surface of the aqueous phase.

Further, while keeping the surface pressure constant, the electrode plate was carefully pulled up at a rate of 2 cm/min at right angle to the surface of the aqueous phase, and whereby an insulating layer as the third layer which was a monomolecular film of stearic acid was formed on the electrode layer of the electrode plate. Then, the resulting plate was pulled up out of the aqueous phase and allowed to stand for 30 minutes or more at room temperature. Further, by repeating this operation twice, a monomolecular built-up film as the third layer which comprised three monomolecular layers of stearic acid molecules was formed on the electrode layer of the electrode plate. The stearic acid remaining on the surface of the aqueous phase was removed completely from the surface of the aqueous phase.

Then, the electrode plate provided the third layer as above was redipped into the aqueous phase from which stearic acid had already been removed completely.

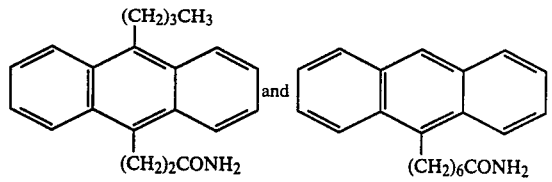

Next, the above two compounds were dissolved in chloroform at mole ratio of 1:1 so that the total concentration was $10^{-3}$ mol/l. The resulting solution (0.5 ml) was spread on the aqueous phase, the surface pressure was regulated to 30 dynes/cm, and a monomolecular film of the above two compounds was formed on the surface of the aqueous phase. The electrode plate was pulled up and dipped carefully (a rate of moving vertically was 2 cm/min) at right angle to the surface of the aqueous phase.

By repeating the above-mentioned operation twice, a monomolecular built-up layer as the first layer comprising four monocolecular layers of the above compounds was formed on the third layer formed previously. Then, the electrode plate was pulled up out of the aqueous phase and allowed to stand for 30 minutes or more at room temperature to dryness again.

Next, the electrode plate was set at a given place in a vapor-deposition chamber of a resistance heating vapor-deposition apparatus, and then carbazole (m.p. 245° C.) was placed in the resistance heating boat. The inner pressure of the chamber was reduced to $10^{-6}$ Torr, and a current flowing through the boat was controlled so that the vapor-deposition rate was 2Å/sec. Thus, a vapor-deposition layer as the second layer which comprised carbazole layer of 200Å thick was formed on the first layer previously formed. Further, while vapor-depositing, the vacuum pressure was $9\times10^{-6}$ Torr, and the temperature of the substrate holder was 20° C.

The forming operation of the monomolecular film comprising stearic acid in formation of the third layer as mentioned above was repeated twice on the second layer as above to form another third layer comprising two monomolecular films of stearic acid. By repeating four times the above-mentioned forming operation of the first layer to the third layer, a luminescent layer (layer thickness; ca. 1500Å) having four interfaces between the first layers and the second layers was prepared.

The electrode plate having an electroluminescent layer thus formed was placed in a vapor-deposition chamber, and an inner pressure of the chamber was reduced to $10^{-6}$ Torr. Further, while regulating the pressure to $10^{-5}$ Torr, aluminum was vapor-deposited in the thickness of 1500Å at a vapor-deposition rate of 20Å/sec onto the third layer finally formed. Thus, an electroluminescent device 40 of the present invention which had a back electrode 45 formed as above was prepared.

As shown in FIG. 4, the electroluminescent device was sealed with sealing-glasses 41. Then, according to a conventional manner, silicone oil 42 which was refined, deaerated and dehydrated was injected into a space between the electroluminescent device and the sealing-glass, to provide an electroluminescent cell 43.

Such electrodes 44 and 45 were impressed with alternating voltage (20 V, 400 Hz) to give luminescence. The luminance and the current density were measured. As the result, the luminance was 24 fL at current density of 0.12 mA/cm$^2$.

EXAMPLE 1e

An ITO layer of a film thickness of 1500Å was formed on a glass surface of 50 mm square according to the sputtering method to afford a transparent electrode plate.

This electrode plate was placed on a predetermined position in the vapor-deposition chamber of the resistance heating vapor-deposition apparatus, and methyl stearate (m.p. 38° C.) was put into the resistance heating boat. After the inner pressure of the chamber was reduced to $10^{-6}$ Torr, the electric current running through the resistance heating boat was regulated so that the vapor-deposition rate could be 2Å/sec, and thereby a vapor-deposited layer consisting of a methyl stearate layer of 200Å thickness was formed as the third layer on the transparent electrode layer of said electrode plate. The pressure in the chamber was adjusted to $9\times10^{-6}$ Torr and the temperature of the substate holder to 20° C. during vapor deposition.

The electrode plate was dipped into an aqueous phase in Langmuir-Trough 4 (tradename, manufactured by Joyce-Loebel Co., Ltd.) where $4\times10^{-4}$ mol/l of $CdCl_2$ was contained in the aqueous phase to adjust it to pH 6.5.

Subsequently, a solution (0.5 ml) of

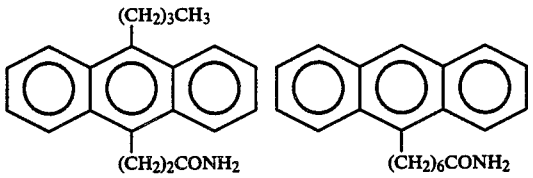

(at a ratio of 1 mol:1 mol and a total concentration of $1\times10^{-3}$ mol/l) in chloroform was spread on the aqueous phase, and a multi-component monomolecular film consisting of the above two compounds was formed by regulating the surface pressure to 30 dyne/cm.

The electrode plate was then moved gently across the water surface upward and downward each twice at a rate of 2 cm/min, and thereby a monomolecular-layer built-up film in which four monomolecular films consisting of the mixture of the above compounds were accumulated was formed as the first layer on the third layer formed before. Then, this electrode plate was pulled out of the aqueous phase and allowed to stand for more than 30 minutes at room temperature.

Furthermore, similarly to the above forming process of the vapor-deposited layer using methyl stearate except for using carbazole (m.p. 245° C.) in place of methyl stearate and adjusting the temperature of the resistance heating boat to a little higher point than the melting point of carbazole, a vapor-deposited layer of 200Å thickness consisting of carbazole was formed as the second layer on the first layer formed before.

Thereafter, the forming process of the third layer to the second layer described above was repeated four times, and finally the third layer was laid, and thereby a luminescent layer (approximately 2000Å thickness) which comprised four boundaries between the first layer and the second layer was formed.

The electrode plate on which the luminescent layer was formed was placed in a vapor deposition chamber. With the vacuum pressure of the chamber being at first reduced to $10^{-6}$ Torr and then adjusted to $10^{-5}$ Torr, an Al layer of 1500Å thickness was vapor-deposited on the third layer formed finally at a deposition rate of 20Å/sec as the back electrode 45 to afford the EL device 40 of the present invention. After this EL device was sealed with sealing glass 41 as shown in FIG. 4, silicone oil 42 which was purified, degasified and dried according to a usual method was introduced into the seal, and thereby EL cell 43 was formed.

To the electrodes 44 and 45 of this EL cell was applied an A.C. voltage of 20 V, 400 Hz to emit light and the luminance was measured to be 12 fL at a current density of 0.09 mA/cm$^2$.

EXAMPLE 1f

An ITO layer of a film thickness of 1500Å was formed on a glass surface of 50 mm square according to the sputtering method to afford a transparent electrode plate.

This electrode plate was placed on the predetermined position in the vapor-deposition chamber of the resistance heating vapor deposition apparatus, and methyl stearate (m.p. 38° C.) was put into the resistance heating boat. After the inner pressure of the chamber was reduced to $10^{-6}$ Torr, the electric current running through the resistance heating boat was regulated so that the vapor deposition rate could be 2Å/sec, and thereby a vapor-deposited layer consisting of a methyl stearate layer of 200Å thickness was formed as the third layer on the transparent electrode layer of said electrode plate. The pressure in the chamber was adjusted to $9\times10^{-6}$ Torr and the temperature of the substrate holder to 20° C. during vapor deposition.

Subsequently, similarly to the above forming process of the third layer except for using anthracene (m.p. 216° C.) in place of methyl stearate and adjusting the temperature of the resistance heating boat to a little higher point than the melting point of anthracene, a vapor-deposited layer of 200Å thickness consisting of anthracene was formed as the first layer on the third layer (the insulating layer).

The electrode plate was dipped into an aqueous phase in Langmuir-Trough 4 (tradename, manufactured by Joyce-Loebel Co., Ltd.) where $4\times10^{-4}$ mol/l of $CdCl_2$ was contained in the aqueous phase to adjust it to pH 6.5.

Then, a solution (0.5 ml) of

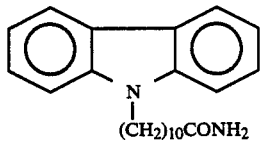

(at a concentration of $1\times10^{-3}$ mol/l) in chloroform was spread on the aqueous phase, and a monomolecular film consisting of the above compounds was formed by regulating the surface pressure to 30 dyne/cm. The electrode plate was then moved upward gently across the water surface and furthermore upward and downward once for each, and thereby a monomolecular layer built-up film in which three monomolecular films consisting of the above compound were accumulated was formed as the second layer on the first layer formed last. The electrode was then pulled out of the aqueous phase and allowed to stand for more than 30 minutes at room temperature.

Thereafter, the forming process of the third layer to the second layer described above was repeated four times, and finally the third layer was laid, and thereby a luminescent layer (approximately 1900Å thickness) which comprised four boundaries between the first layer and the second layer.

The electrode plate on which the luminescent layer was formed was placed in a vapor deposition chamber. With the vacuum pressure of the chamber being at first reduced to $10^{-6}$ Torr, then adjusted to $10^{-5}$ Torr an Al layer of 1500Å thickness was vapor-deposited on the third layer formed finally at a deposition rate of 20Å/sec as the back electrode 45 to afford the EL device 40 of the present invention. After this EL device was sealed with sealing glass 41 as shown in FIG. 4, silicone oil 42 which was purified, degasified and dried according to a usual method was introduced into the seal, and thereby EL cell 43 was formed.

To the electrodes 44 and 45 of this EL cell was applied an A.C. voltage of 20 V, 400 Hz to emit light, and the luminance was measured to be 24 fL at a current density of 0.10 mA/cm$^2$.

EXAMPLE 1g

An ITO layer of a film thickness of 1500Å was formed on a glass surface of 50 mm square according to the sputtering method to afford a transparent electrode plate. This electrode plate was dipped into an aqueous phase in Langmuir-Trough 4 (tradename, manufactured by Joyce-Loebel Co., Ltd.) where $4\times10^{-4}$ mol/l of $CdCl_2$ was contained in the aqueous phase to adjust it to pH 6.5.

Then, a solution (0.5 ml) of stearic acid (at a concentration of $1\times10^{-3}$ mol/l) in chloroform was spread on the aqueous phase. After chloroform was evaporated off from the surface of the aqueous phase, the surface pressure was adjusted to 30 dyne/cm, and thereby a stearic acid film was formed.

The electrode plate was then moved upward gently across the water surface at a rate of 2 cm/min while keeping the surface pressure constant, and thereby a monomolecular film consisting of stearic acid was formed as the third layer on the electrode layer of such an electrode plate. It was pulled out of the aqueous layer, and allowed to stand for more than 30 minutes at room temperature for drying. A monomolecular layer built-up film in which two monomolecular films consisting of stearic acid molecules were accumulated was formed as the third layer on the electrode layer of said electrode plate. Stearic acid left on the surface of the aqueous phase was completely removed from the surface.

Subsequently, this electrode plate was placed on the predetermined position in the vapor deposition chamber of the resistance heating vapor deposition apparatus, and anthracene (m.p. 216° C.) was put into the resistance heating boat. After the inner pressure of the chamber was reduced to $10^{-6}$ Torr, the electric current running through the resistance heating boat was regulated so that the vapor deposition rate could be 2Å/sec, and thereby a vapor-deposited layer consisting of an anthracene deposited layer of 200Å thickness was formed as the first layer on the third layer (the insulating layer) formed last. The pressure in the chamber was adjusted to $9\times10^{-6}$ Torr and the temperature of the substrate holder to 20° C. during vapor deposition.

Furthermore, similarly to the formation of the first layer except for using carbazole (m.p. 245° C.) in place of anthracene and adjusting the temperature of the resistance heating boat to a little higher point than the melting point of carbazole, a vapor-deposited layer of 200Å thickness consisting of carbazole was formed as the second layer on the first layer formed last.

Thereafter, the forming process of the third layer to the second layer described above was repeated four times, and finally the third layer was laid, and thereby a luminescent layer (approximately 1900Å thickness) which comprised four boundaries between the first layer and the second layer.

The electrode plate on which the luminescent layer was formed was placed again in a vapor deposition chamber. With the vacuum pressure of the chamber being at first reduced to $10^{-6}$ Torr then adjusted to $10^{-5}$ Torr, an Al layer of 1500Å thickness was vapor-deposited on the third layer formed finally at a deposition rate of 20Å/sec as the back electrode 45 to afford the EL device 40 of the present invention. After this EL device was sealed with sealing glass 41 as shown in FIG. 4, silicone oil 42 which was purified, degasified and dried according to a usual method was introduced into the seal, and thereby EL cell 43 was formed.

To the electrodes 44 and 45 of this EL cell was applied an A.C. voltage of 20 V, 400 Hz to emit light, and the luninace was measured to be 32 fL at a current density of 0.13 mA/cm$^2$.

We claim:

1. An electroluminescent device which comprises a pair of electrodes and a luminescent layer, the luminescent layer comprising:

(a) a first layer comprising a relatively electron acceptable organic compound, (b) a second layer comprising a relatively electron donative organic compound, and (c) a third layer having an insulating property, the three layers being repeatedly accumulated at least twice, and at least one of the three layers having a Langmuir-Blodgette monomolecular film or a monomolecular layer built-up film.

2. An electroluminescent device according to claim 1, wherein at least one of the pair of electrodes is transparent.

3. An electroluminescent device according to claim 1, wherein said electron acceptable compound is a luminescent Pi-electron containing compound.

4. An electroluminescent device according to claim 1, wherein said electron acceptable compound is selected from fused polycyclic aromatic hydrocarbons, p-terphenyl, 2,5-diphenyloxazole, 1,4-bis (2-methyl-styryl)-benzene, xanthine, coumarin, acridine, cyanine dye, benzophenone, phthalocyanine and metal complexes thereof, porphyrin and metal complexes thereof, 8-hydroxyquinoline and metal complexes thereof, ruthenium complexes, rare earth complexes and derivatives of the above-mentioned compounds, and furthermore, heterocyclic compounds other than those mentioned above derivatives thereof, aromatic amines, aromatic polyamines, and compounds having a quinone structure.

5. An electroluminescent device according to claim 1, wherein said third layer is selected from compounds represented by the following formulae A and B;

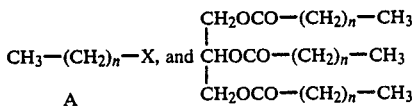

A B (wherein n is $10 \leqq n \leqq 30$, and X is a group of —COOH, —$CONH_2$, —COOR, —$N^+(CH_3)_3 \cdot Cl^-$,

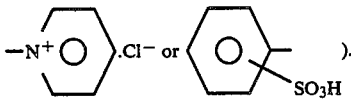

).

6. An electroluminescent device according to claim 1, wherein said first layer has a thickness of 300Å or less.

7. An electroluminescent device according to claim 1, wherein said second layer has a thickness of 300Å or less.

8. An electroluminescent device according to claim 1, wherein said third layer has a thickness of 500Å or less.

9. An electroluminescent device according to claim 1, wherein said whole luminescent layer has a thickness of 1 μm or less.

10. An electroluminescent device according to claim 1, wherein said electrode has a thickness of 0.01 to 0.3 μm.

11. An electroluminescent device which comprises a pair of electrodes and a luminescent layer, the luminescent layer comprising:

(a) a first layer comprising a relatively electron acceptable organic compound, (b) a second layer comprising a relatively electron donative organic compound, and (c) a third layer having an insulating property, these layers being arranged such that, in the direction from one electrode to the other electrode, on the third layer there are successively overlaid the first layer, the second layer and another third layer in the mentioned order and this three-layer set is accumulated at least twice, and at least one of the three layers having a Lagmuir-Blodgett monomolecular film or a monomolecular layer built-up film.

12. An electroluminescent device according to claim 11, wherein at least one of the pair of electrodes is transparent.

13. An electroluminescent device according to claim 11, wherein said electron-acceptable compound is a luminescent Pi-electron containing compound.

14. An electroluminescent device according to claim 11, wherein said electron acceptable compound is selected from fused polycyclic aromatic hydrocarbons, p-terphenyl, 2,5-diphenyloxazole, 1,4-bis (2-methyl-styryl)-benzene, xanthine, coumarin, acridine, cyanine dye, benzophenone, phthalocyanine and metal complexes thereof, porphyrin and metal complexes thereof, 8-hydroxyquinoline and metal complexes thereof, ruthenium complexes, rare earth complexes and derivatives of the above-mentioned compounds, and furthermore, heterocyclic compounds other than those mentioned above, derivatives thereof, aromatic amines, aromatic polyamines, and compounds having a quinone structure.

15. An electroluminescent device according to claim 11, wherein said third layer is selected from compounds represented by the following formulae A and B;

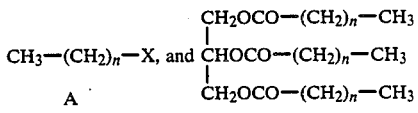

A B (wherein n is $10 \leqq n \leqq 30$, and X is a group of —COOH, —$CONH_2$, —COOR,—$N^+(CH_3)_3 \cdot Cl^-$,

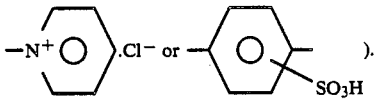

).

16. An electroluminescent device according to claim 11, wherein said first layer has a thickness of 300Å or less.

17. An electroluminescent device according to claim 11, wherein said second layer has a thickness of 300Å or less.

18. An electroluminescent device according to claim 11, wherein said third layer has a thickness of 500Å or less.

19. An electroluminescent device according to claim 11, wherein said whole luminescent layer has a thickness of 1 μm or less.

20. An electroluminescent device according to claim 11, wherein said electrode has a thickness of 0.01 to 0.3 μm.

21. An electroluminescent device according to claim 1, wherein said electron-donative compound is a luminescent Pi-electron containing compound.

22. An electroluminescent device according to claim 1 wherein said electron-donative compound is selected from the group consisting of fused polycyclic aromatic hydrocarbons, p-terphenyl, 2,5-diphenyloxazole, 1,4-bis(2-methyl-styryl)benzene, xanthine, coumarin, acridine, cyanine dye, benzophenone, phthalocyanine and metal complexes thereof, porphyrin and metal complexes thereof, 8-hydroxyquinoline and metal complexes thereof, ruthenium complexes, rare earth complexes and derivatives of the above-mentioned compounds, heterocyclic compounds other than those mentioned above, derivatives thereof, armoatic amines, aromatic polyamines, and compounds having a quinone structure.

23. An electroluminescent device according to claim 11, wherein said electron-donative oompound is a luminescent Pi-electron containing compound.

24. An electroluminescent device according to claim 11, wherein said electron donative compound is selected from the group consisting of fused polycyclic aromatic hydrocarbons, p-terphenyl, 2,5-diphenyloxazole, 1,4-bis(2-methyl-styryl)bezene, xanthine, coumarin, acridine, cyanine dye, benzophenone, phtalocyanine and metal complexes thereof, porphyrin and metal complexes thereof, 8-hydrozyquinoline and metal complexes thereof, ruthenium complexes, rare earth complexes and derivatives of the above-mentioned compounds, heterocyclic compounds other than those mentioned above, derivatives thereof, aromatic amines, aromatic polyamines, and compounds having a quinone structure.

25. The electroluminescent device of claim 1 wherein at least one of said first layer and said second layer is a Langmuir-Blodgett monomolecular film or a monomolecular layer built-up film.

* * * * *